US007866419B2

(12) United States Patent
Lockwood

(10) Patent No.: US 7,866,419 B2
(45) Date of Patent: Jan. 11, 2011

(54) DIAMOND IMPREGNATED BITS USING A NOVEL CUTTING STRUCTURE

(75) Inventor: Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/779,083

(22) Filed: Jul. 17, 2007

(65) Prior Publication Data

US 2008/0017421 A1 Jan. 24, 2008

Related U.S. Application Data

(60) Provisional application No. 60/831,945, filed on Jul. 19, 2006.

(51) Int. Cl.
*E21B 10/36* (2006.01)

(52) U.S. Cl. ..... 175/426; 175/434; 175/374

(58) Field of Classification Search ..... 175/426, 175/434, 374

See application file for complete search history.

(56) References Cited

U.S. PATENT DOCUMENTS

| | | | | |
|---|---|---|---|---|
| 4,255,165 | A * | 3/1981 | Dennis et al. | 51/309 |
| 4,723,996 | A | 2/1988 | Brunet et al. | |
| 4,797,241 | A | 1/1989 | Peterson et al. | |
| 5,116,568 | A | 5/1992 | Sung et al. | |
| 5,120,327 | A | 6/1992 | Dennis | |
| 5,279,374 | A * | 1/1994 | Sievers et al. | 175/374 |
| 5,518,077 | A * | 5/1996 | Blackman et al. | 175/353 |
| 5,524,719 | A * | 6/1996 | Dennis | 175/432 |
| 5,598,621 | A | 2/1997 | Littecke et al. | |
| 5,676,496 | A | 10/1997 | Littecke et al. | |
| 5,755,298 | A | 5/1998 | Langford, Jr. et al. | |
| 5,755,299 | A * | 5/1998 | Langford et al. | 175/375 |
| 5,889,219 | A | 3/1999 | Moriguchi et al. | |
| 6,095,265 | A | 8/2000 | Alsup | |
| 6,102,140 | A * | 8/2000 | Boyce et al. | 175/374 |
| 6,138,779 | A * | 10/2000 | Boyce | 175/374 |
| 6,170,583 | B1 | 1/2001 | Boyce | |
| 6,238,280 | B1 | 5/2001 | Ritt et al. | |
| 6,286,498 | B1 | 9/2001 | Sung | |
| 6,319,460 | B1 | 11/2001 | Fang | |
| 6,394,202 | B2 | 5/2002 | Truax et al. | |
| 6,454,027 | B1 | 9/2002 | Fang et al. | |
| 6,601,662 | B2 * | 8/2003 | Matthias et al. | 175/374 |
| 6,610,113 | B1 | 8/2003 | Mehrotra et al. | |

(Continued)

FOREIGN PATENT DOCUMENTS

CA 2594037 11/2008

(Continued)

OTHER PUBLICATIONS

German Final Office Action for related Application No. 102005048687.8, dated Mar. 16, 2009 (10 pages).

(Continued)

*Primary Examiner*—David J Bagnell
*Assistant Examiner*—Cathleen R Hutchins

(57) ABSTRACT

An insert for a drill bit that includes a plurality of encapsulated particles dispersed in a first matrix material, where the encapsulated particles include a coarse particle encapsulated within a shell, and wherein the shell comprises abrasive particles dispersed in a second matrix material is disclosed.

27 Claims, 9 Drawing Sheets

U.S. PATENT DOCUMENTS

| | | | | |
|---|---|---|---|---|
| 6,742,611 | B1 | 6/2004 | Illerhaus et al. | |
| 7,048,081 | B2 * | 5/2006 | Smith et al. | 175/434 |
| 7,350,599 | B2 | 4/2008 | Lockwood et al. | |
| 2001/0047891 | A1 | 12/2001 | Truax et al. | |
| 2004/0238227 | A1 * | 12/2004 | Smith et al. | 175/431 |
| 2005/0109545 | A1 * | 5/2005 | Lockwood et al. | 175/374 |
| 2006/0081402 | A1 * | 4/2006 | Lockwood et al. | 175/374 |
| 2006/0162967 | A1 | 7/2006 | Brackin et al. | |
| 2006/0213128 | A1 | 9/2006 | Sung | |
| 2008/0128951 | A1 | 6/2008 | Lockwood et al. | |
| 2008/0282618 | A1 | 11/2008 | Lockwood | |
| 2009/0120008 | A1 | 5/2009 | Lockwood et al. | |

FOREIGN PATENT DOCUMENTS

| | | | |
|---|---|---|---|
| DE | 69627053 | | 8/2000 |
| DE | 10031833 | A1 | 1/2001 |
| DE | 102005048687 | | 5/2006 |
| EP | 0046374 | | 2/1982 |
| EP | 0370199 | | 5/1990 |
| EP | 0493351 | A2 | 7/1992 |
| EP | 0579376 | | 1/1994 |
| EP | 1028171 | | 3/2003 |
| GB | 2362655 | | 11/2001 |
| GB | 2405413 | | 2/2005 |
| GB | 2419617 | | 8/2007 |
| GB | 2440438 | | 1/2008 |
| GB | 2436974 | | 4/2008 |
| GB | 2443574 | | 9/2008 |
| GB | 2450177 | | 12/2008 |
| GB | 2454589 | | 5/2009 |
| RU | 2216435 | | 11/2003 |
| WO | 9936590 | | 7/1999 |
| WO | 9936658 | | 7/1999 |
| WO | 0123630 | | 4/2001 |
| WO | 0245907 | | 6/2002 |
| WO | 2004029310 | | 4/2004 |
| WO | 2006063136 | | 6/2006 |
| WO | 2008103417 | | 8/2008 |

OTHER PUBLICATIONS

Canadian Office Action issued in Application No. 2,593,951 dated Apr. 30, 2009 (2 pages).

Response dated Mar. 2, 2010 to Examination report dated Sep. 2, 2009 for related CA application No. 2,594,037 filed Jul. 18, 2007.

Response dated Apr. 1, 2010 to Examination report dated Dec. 4, 2009 for related application No. 0714147.6 (2450177) filed Jul. 19, 2007.

Response dated Mar. 31, 2010 to Examination report dated Feb. 1, 2010 for related GB application No. 0820485.1 (2454589) filed Nov. 7, 2008.

Canadian Examination Report dated Mar. 11, 2010 for corresponding CA application No. 2,593,951 filed Jul. 18, 2007.

US Office Action dated Mar. 30, 2010 for related U.S. Appl. No. 12/021,131, filed Jan. 28, 2008.

Response dated Jun. 30, 2010 to US Office Action dated Mar. 30, 2010 for related U.S. Appl. No. 12/021,131, filed Jan. 28, 2008.

Combined Search and Examination Report dated Apr. 22, 2010 for related GB application No. 1005530.9 filed Mar. 31, 2010.

Examination report dated Aug. 6, 2009 for corresponding application GB0714150.0 filed Jul. 19, 2007.

Response dated Dec. 7, 2009 to Examination report dated Aug. 6, 2009 for corresponding application GB0714150.0.

Response dated Oct. 30, 2009 to CA Office Action for corresponding CA application No. 2,593,951.

Examination report dated Sep. 2, 2009 for related CA application No. 2,594,037 filed Jul. 18, 2007.

Examination report dated Dec. 5, 2007 for related GB application No. 0714147.6 (2450177) filed Jul. 19, 2007.

Response dated Sep. 18, 2009 to Examination Report dated Dec. 5, 2007 for related GB application No. 0714147.6 (2450177) filed Jul. 19, 2007.

Examination report dated Dec. 4, 2009 for related GB application No. 0714147.6 (2450177) filed Jul. 19, 2007.

Examination report dated Feb. 1, 2010 for related GB application No. 0820485.1 (2454589) filed Nov. 7, 2008.

Search and Examination report dated Jan. 6, 2009 for related GB application no. 0820485.1 (2454589) filed Nov. 7, 2008.

Search and Examination report dated Nov. 20, 2007 for corresponding application GB0714150.0 filed Jul. 19, 2007.

Response dated Jun. 23, 2009 to Exam Rpt dated Nov. 20, 2007 for corresponding application GB0714150.0 filed Jul. 19, 2007.

* cited by examiner

DIAMOND IMPREGNATED BITS USING A NOVEL CUTTING STRUCTURE

CROSS-REFERENCE TO RELATED APPLICATIONS

This application, pursuant to 35 U.S.C. §119, claims the benefit of U.S. patent application Ser. No. 60/831,945, filed on Jul. 19, 2006, which is herein incorporated by reference in its entirety.

BACKGROUND OF INVENTION

1. Field of the Invention

Embodiments disclosed herein relate generally to drill bits used in the oil and gas industry and more particularly, to drill bits having diamond-impregnated cutting surfaces.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper movement of fluid used to remove the rock cuttings and cool the exposed diamonds is important for the proper function and performance of diamond impregnated bits. The cutting face of a diamond impregnated bit typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

An example of a prior art diamond impregnated drill bit ("impreg bit") is shown in FIG. 1. The impreg bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impreg bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impreg bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 22 in accordance with the '202 patent comprises a shank 24 and a crown 26. Shank 24 is typically formed of steel and includes a threaded pin 28 for attachment to a drill string. Crown 26 has a cutting face 29 and outer side surface 30. According to one embodiment, crown 26 is formed by infiltrating a mass of tungsten-carbide powder impregnated with synthetic or natural diamond, as described above.

Crown 26 may include various surface features, such as raised ridges 32. Preferably, formers are included during the manufacturing process so that the infiltrated, diamond-impregnated crown includes a plurality of holes or sockets 34 that are sized and shaped to receive a corresponding plurality of diamond-impregnated inserts 36. Once crown 26 is formed, inserts 36 are mounted in the sockets 34 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 34 can be inclined with respect to the surface of the crown 26. In this embodiment, the sockets are inclined such that inserts 36 are oriented substantially in the direction of rotation of the bit, so as to enhance cutting.

As a result of the manufacturing technique of the '202 patent, each diamond-impregnated insert is subjected to a total thermal exposure that is significantly reduced as compared to previously known techniques for manufacturing infiltrated diamond-impregnated bits. For example, diamonds imbedded according to methods disclosed in the '202 patent have a total thermal exposure of less than 40 minutes, and more typically less than 20 minutes (and more generally about 5 minutes), above 1500° F. This limited thermal exposure is due to the shortened hot pressing period and the use of the brazing process.

The total thermal exposure of methods disclosed in the '202 patent compares very favorably with the total thermal exposure of at least about 45 minutes, and more typically about 60-120 minutes, at temperatures above 1500° F., that occurs in conventional manufacturing of furnace-infiltrated, diamond-impregnated bits. If diamond-impregnated inserts are affixed to the bit body by adhesive or by mechanical means such as interference fit, the total thermal exposure of the diamonds is even less.

With respect to the diamond material to be incorporated (either as an insert, or on the bit, or both), diamond granules are formed by mixing diamonds with matrix power and binder into a paste. The paste is then extruded into short "sausages" that are rolled and dried into irregular granules. The process for making diamond-impregnated matrix for bit bodies involves hand mixing of matrix powder with diamonds and a binder to make a paste. The paste is then packed into the desired areas of a mold. The resultant irregular diamond distribution has clusters with too many diamonds, while other areas are void of diamonds. The diamond clusters lack sufficient matrix material around them for good diamond retention. The areas void or low in diamond concentration have poor wear properties. Accordingly, the bit or insert may fail prematurely, due to uneven wear. As the motors or turbines powering the bit improve (higher sustained RPM), and as the drilling conditions become more demanding, the durability of diamond-impregnated bits needs to improve. What is still needed, therefore, are techniques for improving the wear properties of, rate of penetration of, and diamond distribution in impregnated cutting structures.

SUMMARY OF INVENTION

In one aspect, embodiments disclosed herein relate to an insert for a drill bit that includes a plurality of encapsulated particles dispersed in a first matrix material, where the encapsulated particles include a particle encapsulated within a shell, and wherein the shell comprises abrasive particles dispersed in a second matrix material.

In another aspect, embodiments disclosed herein relate to an impreg drill bit that includes a bit body and a plurality of ribs formed in the bit body, wherein at least one rib is infiltrated with a plurality of encapsulated particles that include a particle encapsulated within a shell, and wherein the shell comprises abrasive particles dispersed in a matrix material.

In yet another aspect, embodiments disclosed herein relate to a method of forming a diamond-impregnated cutting structure that includes encapsulating particles within a shell, wherein the shell comprises abrasive particles dispersed in a first matrix material, loading a plurality of the encapsulated particles into a mold cavity, pre-compacting the encapsulated particles using a cold-press cycle, and heating the compacted encapsulated particles to form the diamond impregnated cutting structure.

Other aspects and advantages of the invention will be apparent from the following description and the appended claims.

DETAILED DESCRIPTION

In one aspect, embodiments disclosed herein relate to encapsulated particles. In other aspects, embodiments disclosed herein relate to inserts, diamond impregnated cutting structures, or drill bits containing encapsulated particles.

Figure 3:
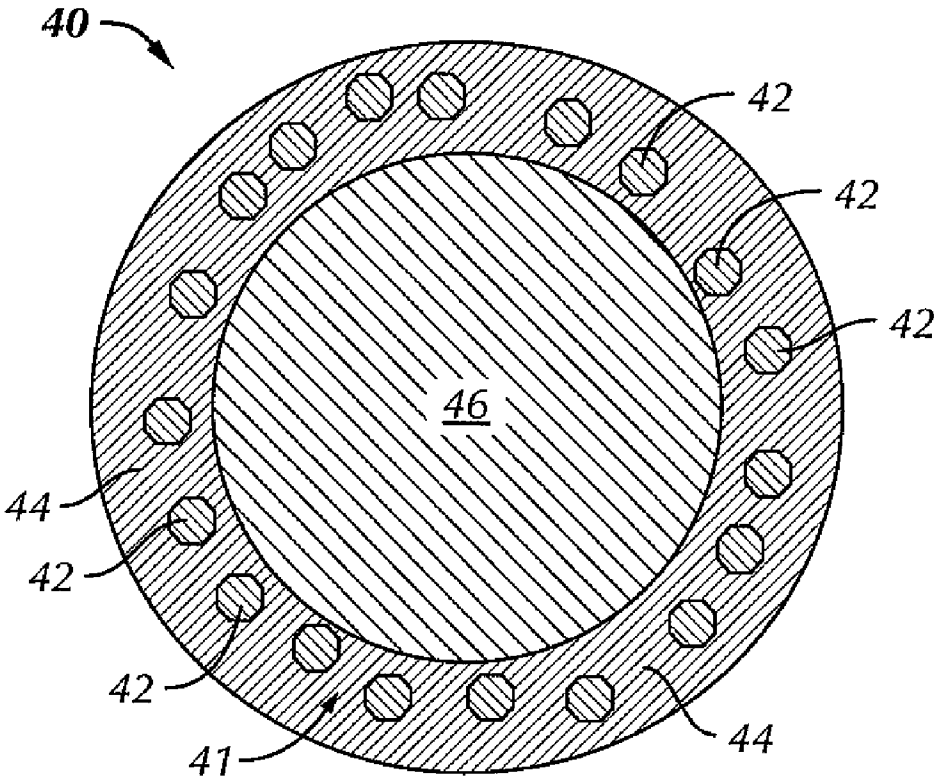
FIG. 3 illustrates an embodiment of an encapsulated abrasive according to one embodiment.

Referring to FIG. 3, an encapsulated particle 40 is illustrated. Encapsulated particle 40 may include a shell 41 formed from abrasive particles 42 and matrix material 44. Shell 41 may uniformly clad, coat or surround a coarse particle 46. Each of the component parts will be discussed followed by a description of embodiments using encapsulated particles 40, such as inserts, diamond impregnated cutting structures, or a drill bit, for example.

Abrasives

In some embodiments, abrasive particles 42 may be synthetic diamond, CVD coated synthetic diamond, natural diamond, cubic boron nitride (CBN), thermally stable polycrystalline diamond (TSP), or combinations thereof. In other embodiments, abrasive particles 42 may include encapsulated abrasives, such as an encapsulated diamond, for example.

In some embodiments, abrasive particles 42 may range in size from 0.01 to 1.0 mm. In other embodiments, abrasive particles 42 may range in size from 0.1 to 0.9 mm; and from 0.2 to 0.6 mm in yet other embodiments. In other embodiments, abrasive particles 42 may include particles not larger than would be filtered by a screen of 18 mesh (not larger than about 1.0 mm). In other embodiments, abrasive particles 42 may range in size from −30+70 mesh. As used herein, although particle sizes or particle diameters are referred to, it is understood by those skilled in the art that the particles may not be spherical in shape. Further, one of ordinary skill would recognize that the particle sizes and distribution of the particle sizes of the abrasive particles may be selected to allow for a broad, uniform, or bimodal distribution, for example, depending on a particular application.

Particle sizes are often measured in a range of mesh sizes, for example −40+80 mesh. The term "mesh" actually refers to the size of the wire mesh used to screen the particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the particles is defined by the largest and smallest grade of mesh used to screen the particles. Particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm.

Matrix

In some embodiments, the matrix used to form encapsulated particles 40 preferably satisfies several requirements. The matrix preferably has sufficient hardness so that the diamonds exposed at the cutting face are not pushed into the matrix material under the very high pressures encountered in drilling. In addition, the matrix preferably has sufficient abrasion resistance so that the diamond particles are not prematurely released. Lastly, the heating and cooling times during sintering or hot-pressing, as well as the maximum temperature of the thermal cycle, preferably are sufficiently low that the diamonds embedded therein are not thermally damaged during sintering or hot-pressing.

In some embodiments, matrix 44 may be formed from carbides or nitrides of tungsten, vanadium, boron, titanium, or combinations thereof. In other embodiments, the following materials may be used to form matrix 44: tungsten carbide (WC), tungsten (W), sintered tungsten carbide/cobalt (WC—Co) (spherical or crushed), cast tungsten carbide (spherical or crushed) or combinations of these materials (with an appropriate binder phase such as cobalt, iron, nickel, or copper to facilitate bonding of particles and diamonds), and the like. In various embodiments the matrix 44 may include at least one of macrocrystalline tungsten carbide ranging in size from about 5 to 150 microns, carburized tungsten carbide ranging in size from about 0.1 to 10 microns, cast tungsten carbide ranging in size from about 5 to 150 microns, and sintered tungsten carbide ranging in size from about 5 to 200 microns. One of ordinary skill in the art would recognize that the particular combination of carbides used in the matrix material may depend for example on whether the particles disclosed herein are being used in a insert or a rib of a bit body so that desired properties such as wear resistance and ability to be infiltrated can be optimized. In other embodiments, carbides, oxides, and nitrides of Group 4a, 5a, or 6a metals may be used. In yet other embodiments, the carbide included in the matrix may be a tungsten carbide, a boron carbide, and combinations thereof.

In other embodiments, matrix 44 may include hard or soft compounds, and may include metals, metal alloys, carbides, and combinations thereof. In some embodiments, matrix 44 may include Co, Ni, Cu, Fe, and combinations and alloys thereof. In various other embodiments, matrix 44 may include a Cu—Mn—Ni alloy, Cu—Zn—Ni alloy, Cu—Mn—Ni—Zn—Sn alloy, and/or Co—Cu alloy. In other embodiments, matrix 44 may include carbides in addition to Co, Cu, Ni, Fe, and combinations and alloys thereof. In yet other embodiments, the matrix may include from 50 to 70 weight percent of at least one carbide and from 30 to 50 weight percent of at least one metal/metal alloy.

Shell

A mixture of matrix 44 and abrasive particles 42 may be used to form shell 41 using any technique known to those skilled in the art. A desirable thickness for shell 41 may vary with the sizes of abrasive particles 42 and large particles 46 used in forming encapsulated particle 40. In some embodiments, shell 41 may have an average thickness ranging from 0.1 to 1.5 mm. In other embodiments, shell 41 may have an average thickness ranging from 0.1 to 1.3 mm; from 0.15 to 1.1 mm in other embodiments; and from 0.2 to 1.0 mm in yet other embodiments.

Coarse Particles

In some embodiments, coarse particle 46 may be a sintered tungsten carbide, WC—Co, macrocrystalline tungsten carbide, cast tungsten carbide, reclaimed natural or synthetic diamond grit, thermally stable polycrystalline diamond (TSP), tungsten, silicon carbide, boron carbide, aluminum oxide, tool steel, and combinations thereof. In other embodiments, particles 46 may include cubic boron nitride particles.

In certain embodiments, the coarse particles 46 may include materials having a high elastic modulus. In some embodiments, the large particles may have an elastic modulus of 350 GPa or greater; 400 GPa or greater in other embodiments; 450 GPa or greater in other embodiments; 600 GPa or greater in other embodiments; and 1000 GPa or greater in yet other embodiments. One of skill in the art would recognize that depending on the particular drilling operation, an appropriate large particle 46, and thus elastic modulus may be selected so that particle 46 may undergo minimal compression during applied loads encountered during drilling. For example, an elastic modulus of 450 GPa or greater may be attained by using silicon carbide or tungsten carbide and a modulus of 1000 GPa or greater may be attained by using diamond.

Particles 46 may be in the shape of spheres, cubes, irregular shapes, or other shapes. In some embodiments, particle 46 may range in size from 0.2 to 2.0 mm in length or diameter. In other embodiments, particle 46 may range in size from 0.3 to 1.5 mm; from 0.4 to 1.2 mm in other embodiments; and from 0.5 to 1.0 mm in yet other embodiments. In other embodiments, particles 46 may include particles not larger than would be filtered by a screen of 10 mesh. In other embodiments, particles 46 may range in size from −15+35 mesh.

Encapsulated Particles

Coarse particles 46 may be encapsulated with shell 41 using encapsulation techniques known to those of ordinary skill in the art, thus forming encapsulated particles 40. The encapsulated particles 40 may then be impregnated into a drill bit or a rib of a drill bit. In some embodiments, shell 41 may form a uniform coating around large particles 46. For example, encapsulated particles 40 may be emplaced (infiltrated) into a rib in a standard impreg rib or hot-pressed in GHI segment that are later brazed or cast into the rib.

While the encapsulated particles 40 are shown as spheres of approximately the same size and shape, the present invention is not so limited. The encapsulated particles may comprise other shapes, such as ellipses, rectangles, squares, or non-regular geometries, or mixtures of the shapes. In some embodiments, encapsulated particles 40 may have an average diameter (or equivalent diameter) ranging from 0.3 to 3.5 mm. In other embodiments, encapsulated particles 40 may have an average diameter ranging from 0.4 to 3.0 mm; from 0.5 to 2.5 mm in other embodiments; and from 0.7 to 2.0 mm in yet other embodiments. In other embodiments, encapsulated particles 40 may include particles not larger than would be filtered by a screen of 5 mesh. In other embodiments, encapsulated particles 40 may range in size from −10+25 mesh.

Certain embodiments disclosed herein relate to using "uniformly" coated particles. As used herein, the term "uniformly coated" means that that individual particles have similar amounts of coating (i.e., they have relatively the same size), in approximately the same shape (e.g. spherical coating), and that single large particles 46 are coated rather than forming clusters. The term "uniformly" is not intended to mean that all the particles have the exact same size or exact same amount of coating, but simply that they are substantially uniform. The present inventor has discovered that by using particles having a uniform shell layer coating each particle provides consistent spacing between the particles in the finished parts.

Thus, advantageously, certain embodiments, by creating impregnated structures having more uniform distribution, may result in products having more uniform wear properties, improved particle retention, and increased diamond concentration for a given volume, when compared to prior art structures. In addition, coating uniformity permits the use of minimal coating thickness, thus allowing an increased diamond concentration to be used.

In selected embodiments, diamond granules have a substantially uniform matrix layer around each crystal and provide a substantially consistent spacing between the diamonds. This prevents diamond contiguity and provides adequate matrix around each crystal to assure good diamond retention. Uniform diamond distribution permits high diamond concentration without risk of contiguity, and provides for consistent wear life.

Cutting Structures Utilizing Encapsulated Particles

In one embodiment, uniformly coated encapsulated particles are manufactured prior to the formation of the impregnated bit. An exemplary method for achieving "uniform coatings" is to mix the large particles 46, matrix powder 44, abrasive particles 42, and an organic binder in a commercial mixing machine such as a Turbula Mixer or similar machine used for blending diamonds with matrix. The resultant mix may then be processed through a "granulator" in which the mix is extruded into short "sausage" shapes which are then rolled into balls and dried. The granules that are so formed must be separated using a series of mesh screens in order to obtain the desired yield of uniformly coated crystals. At the end of this process, a number of particles of approximately the same size and shape can be collected. Another exemplary method for achieving a uniform matrix coating on the crystals is to use a machine called a Fuji Paudal pelletizing machine. The uniformly coated particles may then be transferred into a mold cavity, compacted, and formed into an insert. One such process is described in U.S. Patent Application Publication No. 2006/0081402 A1. Alternatively, the encapsulated particles placed into mold cavity, and an additional matrix material (such as a tungsten shoulder powder, or tungsten carbide powder) may be poured into the mold with the encapsulated particles prior to infiltration or consolidation of the mold contents. Use of an additional matrix material with encapsulated particles is described in U.S. patent application Ser. No. 60/938,827, which is assigned to the present assignee and herein incorporated by reference in its entirety. For example, in a particular embodiment, an additional matrix material may be used with encapsulated particles such that the additional matrix material in which the encapsulated particles is dispersed may possess a different material property, such as softness/hardness, as compared to the matrix material that encapsulates or forms a shell around coarse particles.

One of ordinary skill in the art would appreciate that the encapsulated particles disclosed herein may be used to form inserts, cutting structures or bit bodies using any suitable method known in the art. Heating of the material can be by furnace or by electric induction heating, such that the heating and cooling rates are rapid and controlled in order to prevent damage to the diamonds. The inserts may be heated by resistance heating in a graphite mold. The dimensions and shapes of the inserts and of their positioning on the bit can be varied, depending on the nature of the formation to be drilled.

It will further be understood that the concentration of diamond or abrasive particles in the inserts can differ from the concentration of diamond or abrasive particles in the bit body. According to one embodiment, the concentrations of diamond in the inserts and in the bit body are in the range of 50 to 150 (100=4.4 carat/$cm^3$). A diamond concentration of 100 is equivalent to 25 percent by volume diamond. Those having ordinary skill in the art will recognize that other concentrations of diamonds may also be used depending on particular applications.

Further, while reference has been made to a hot-pressing process above, embodiments disclosed herein may use a high-temperature, high-pressure press (HTHP) process. Alternatively, a two-stage manufacturing technique, using both the hot-pressing and the HTHP, may be used to promote the development of high concentration (>120 conc.) while achieving maximum bond or matrix density. The HTHP press can improve the performance of the final structure by enabling the use of higher diamond volume percent (including bi-modal or multi-modal diamond mixtures) because ultrahigh pressures can consolidate the bond material to near full density (with or without the need for low-melting alloys to aid sintering).

The HTHP process has been described in U.S. Pat. Nos. 5,676,496 and 5,598,621. Another suitable method for hot-compacting pre-pressed diamond/metal powder mixtures is hot isostatic pressing, which is known in the art. See Peter E. Price and Steven P. Kohler, "Hot Isostatic Pressing of Metal Powders", Metals Handbook, Vol. 7, pp. 419-443 (9th ed. 1984).

Figure 4:
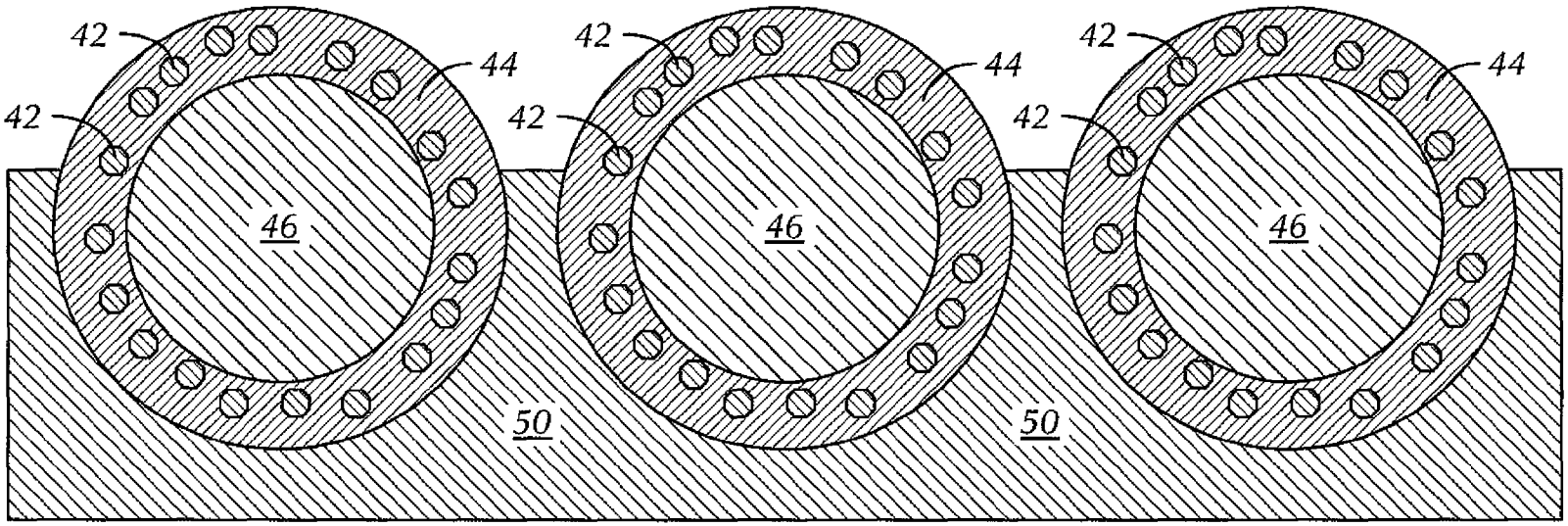
FIG. 4 illustrates a cross section of an embodiment of an encapsulated abrasive infiltrated into a rib of a drill bit or hot pressed into a grit hot-pressed segment (GHI).
Figure 5:
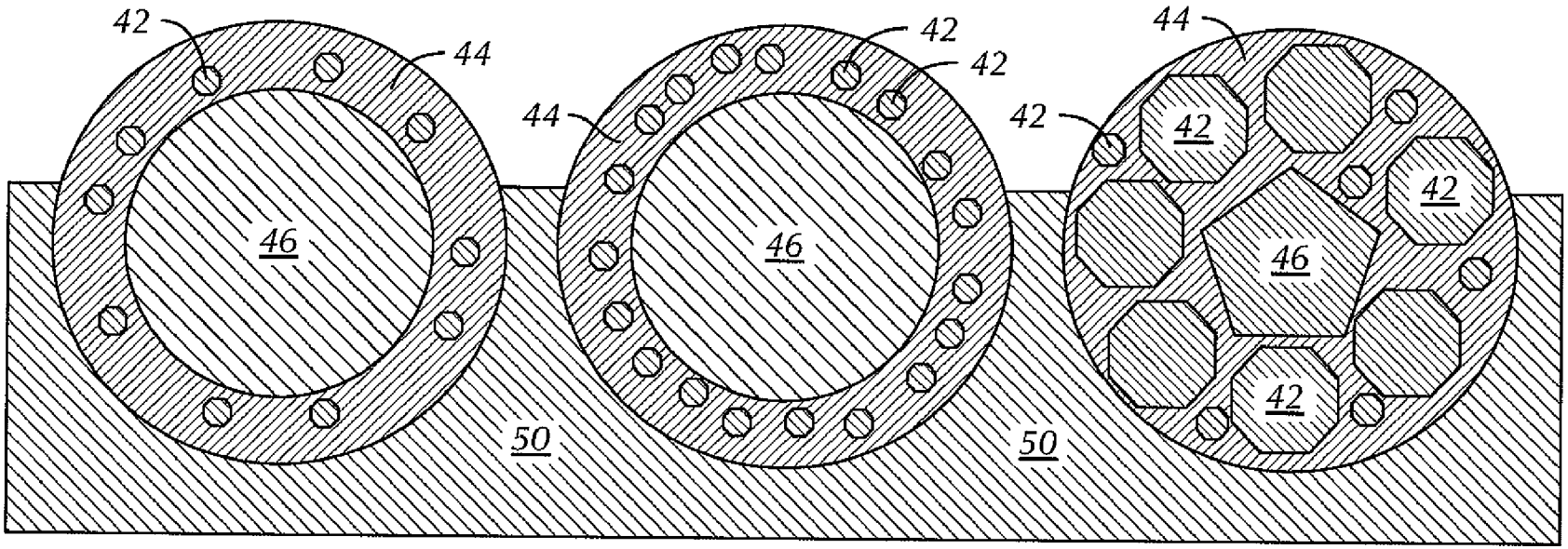
FIG. 5 illustrates a cross section of an embodiment of an encapsulated abrasive infiltrated into a rib of a drill bit or hot pressed into GHI.

Referring to FIG. 4, a cross-sectional view of a rib 50 forming part of a diamond impregnated bit is illustrated. A drill bit or a rib on a drill bit may include multiple encapsulated particles 40, described above. The encapsulated particles 40 may be uniform in size, shape, and composition. Alternatively, rib 50 may include encapsulated particles 40 having varied sizes, shapes, and compositions of the components (matrix 44, particles 46, abrasive particles 42), as is illustrated in FIG. 5.

Figure 6:
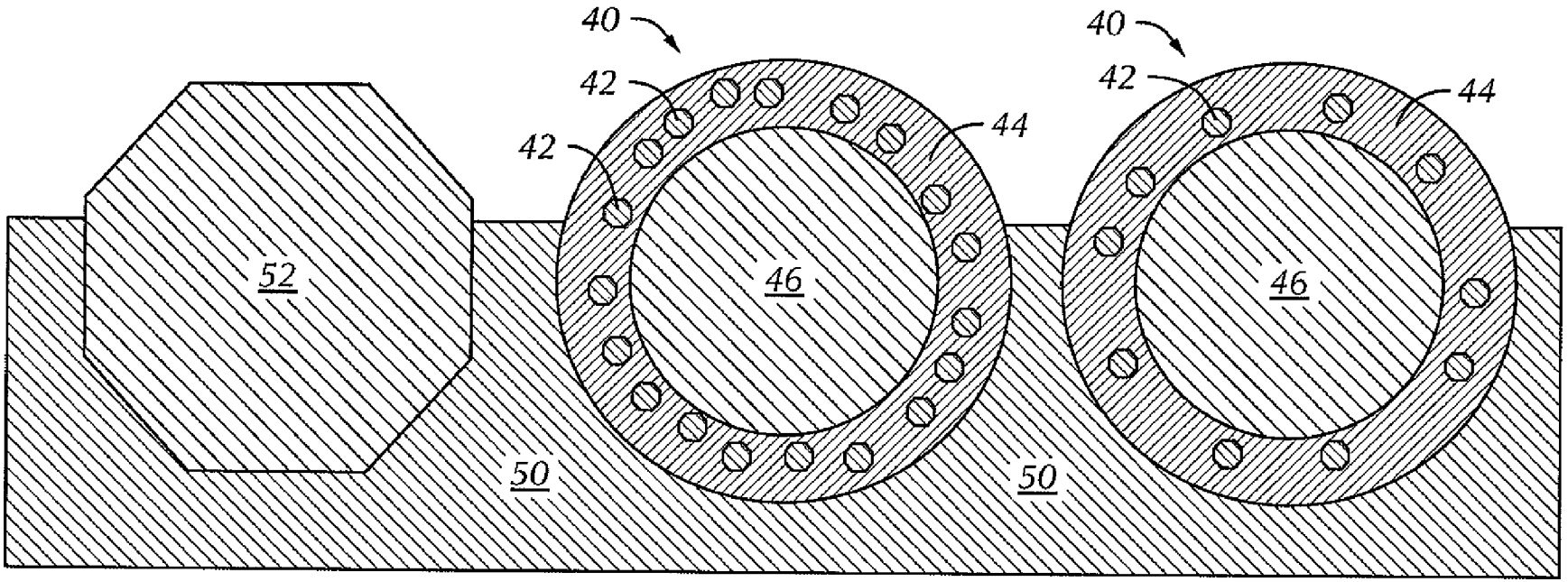
FIG. 6 illustrates a cross section of a rib containing grit and an embodiment of the encapsulated abrasive.

It should be noted that combinations of coated and uncoated diamonds may be used, depending on the particular application. For example, FIG. 6 illustrates a rib 50 containing both diamond grit 52 and various encapsulated particles 40.

In some embodiments, the multiple encapsulated particles 40 on rib 50 may include particles 46 of varying size, varying composition, or combinations thereof. In other embodiments, the multiple encapsulated particles 40 may include shells 41 of varying thickness, varying composition, or combinations thereof. In other embodiments, the multiple encapsulated particles 40 may include abrasive particles 42 of varying size, varying composition, varying size distribution, and combinations thereof. In yet other embodiments, the drill bit or a rib on a drill bit may additionally include (be impregnated with) standard grit.

In various other embodiments, the encapsulated particles disclosed herein may have localized placement in a rib body. For example, encapsulated particles may be placed at the top of the bit being the first section of the bit to drill or solely imbedded deeper within the bit for drilling of the latter sections encountered during a bit run. Additionally, one of skill in the art would recognize that it may be advantageous to place the encapsulated particles at other strategic positions, such as, for example, in the gage area, and leading, or trailing sides of a rib/blade.

Projected Wear Progression

Figure 7A:
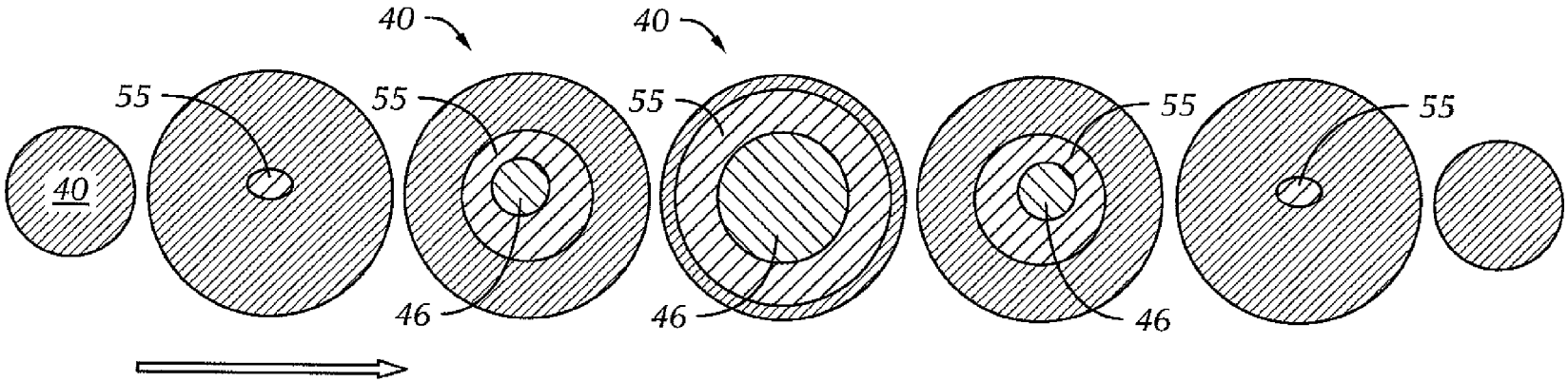
FIGS. 7*a* and 7*b* illustrate a projected wear progression for an embodiment of the encapsulated abrasive infiltrated into a rib of a drill bit or hot pressed into GHI.
Figure 7B:
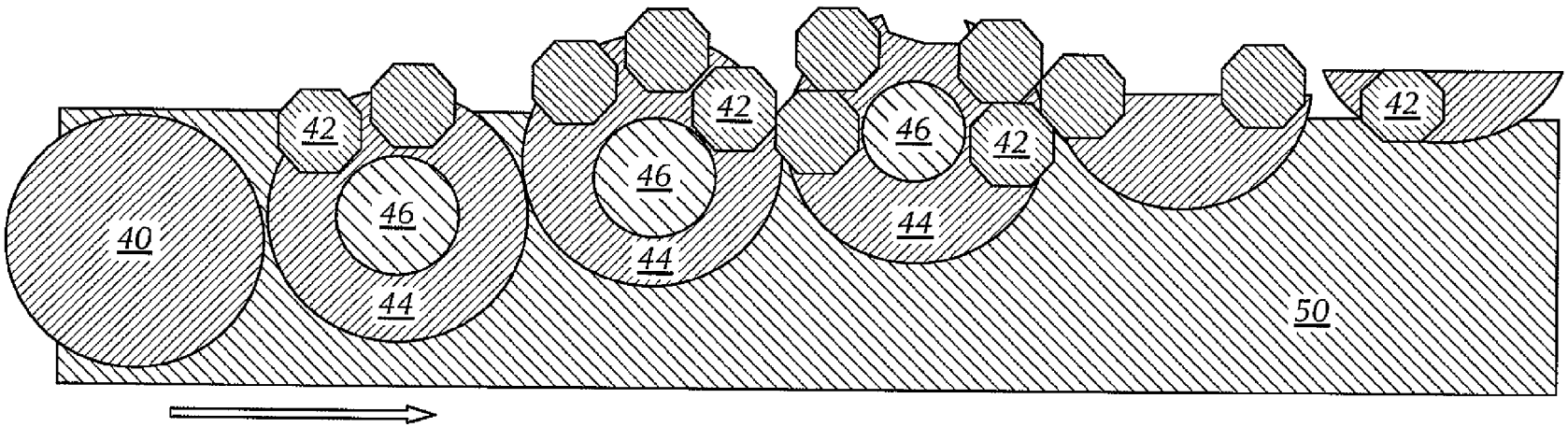

Referring to FIGS. 7*a* and 7*b*, a top view and a cross-sectional view of a projected wear progression of encapsulated particle 40 are illustrated, respectively. Working from left to right as indicated by the arrow, initially, rib 50 wears, exposing a top portion of encapsulated particle 40. As the rib 50 and matrix layer 44 erode, abrasive particles 42 in shell 41 and particle 46 are exposed, increasing the abrasive contact area 55 with the formation. Wear may progress until encapsulated particle 40 is worn through.

Figure 8:
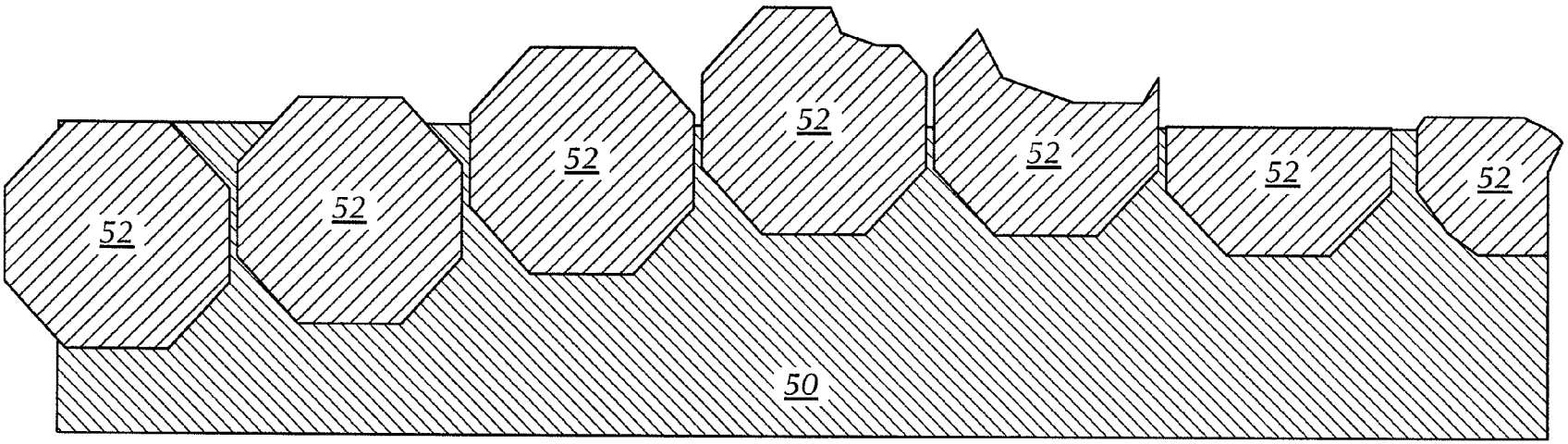
FIG. 8 PRIOR ART
FIG. 8 illustrates the wear progression for a typical abrasive grit infiltrated into a rib of a drill bit or hot pressed into GHI.

The typical wear progression of encapsulated particles illustrated in FIG. 7*b* may be compared with the wear progression for standard grit in FIG. 8. Referring now to FIG. 8, standard grit 52 is exposed and worn in a similar manner to that described above for FIGS. 7*a* and 7*b*. The diamond grit is exposed, and upon continued contact with the formation, wears and fractures. As wear progresses further, standard grit 52 may be dislodged from rib 50.

In comparison, as illustrated in FIG. 7*b*, the abrasive particles 42 in encapsulated particle 40 maintain a good exposure of diamond. Additionally, due to the smaller particle size of abrasive particles 42 compared to grit 52, the abrasive particles 42 undergo significantly less fracture than grit 52, which may allow the bit to maintain a sharp cutting edge for a longer duration than using coarse grit.

Figure 9:
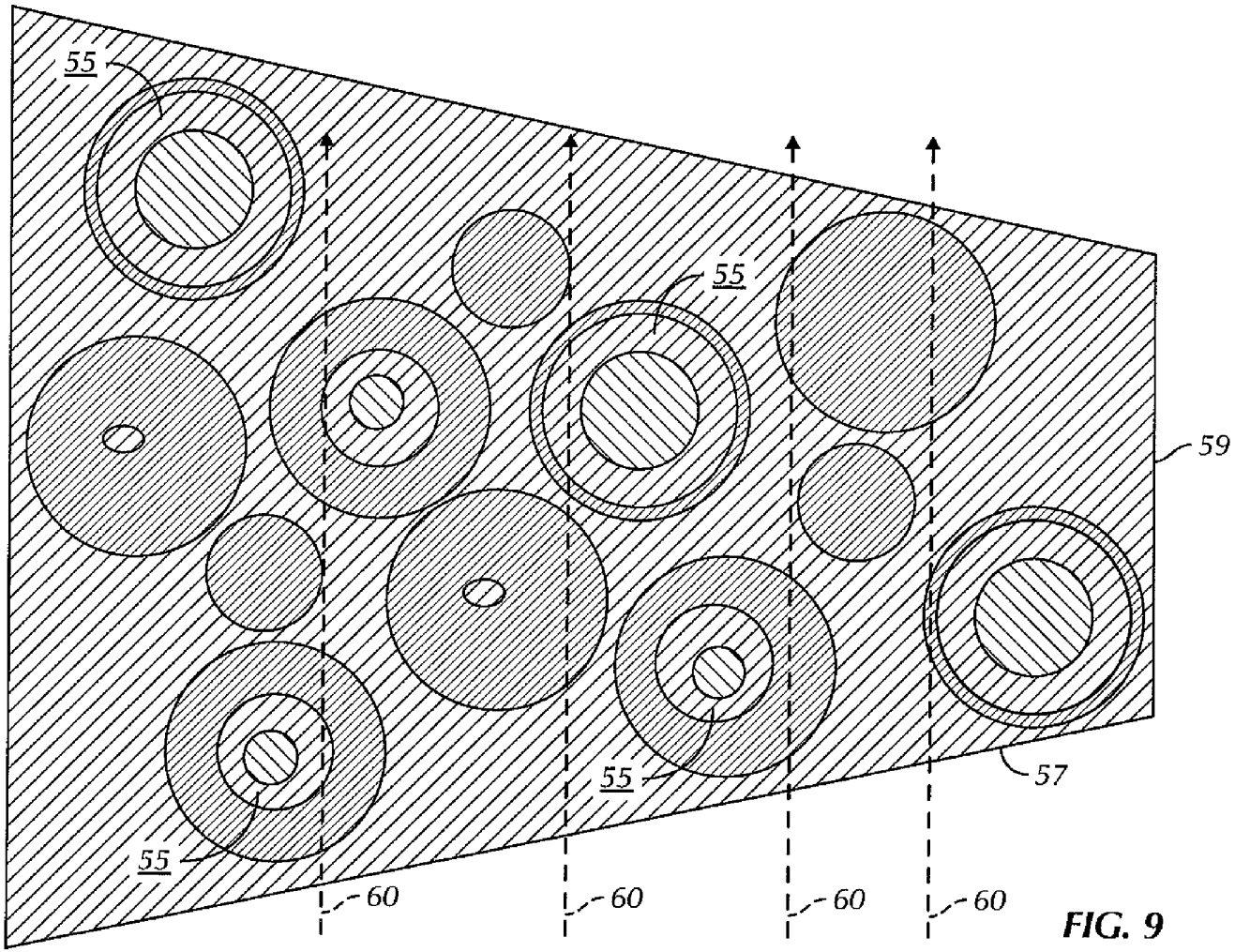
FIG. 9 illustrates a top view of a cutting element containing an embodiment of the encapsulated abrasive.

Referring now to FIG. 9, a top view of a rib or cutting surface containing encapsulated particles 40 is illustrated. Encapsulated particles 40 may be dispersed along the cutting surface, which can have a leading edge 57 and a cone area 59. Space provided between encapsulated particles may provide areas for fluid passage and cutting removal along paths 60, replenishing the cooling/lubricating fluid to the cutting surface over the leading edge 57 of the blade and maintaining the bit free of debris. Additionally, the exposed diamond surface area 55 may vary depending upon particle wear progression and any differences in the depth of encapsulated particles 40 in the matrix material of the rib 50. The wear progression allows for the controlled exposure of fresh grit, maintaining a sharp bit during wear. The combination of fluid flow, cuttings removal, and diamond surface area provided may result in a bit having good wear resistance and an increased rate of penetration compared to bits impregnated solely with diamond grit.

Shell Having Encapsulated Diamonds

Figure 10:
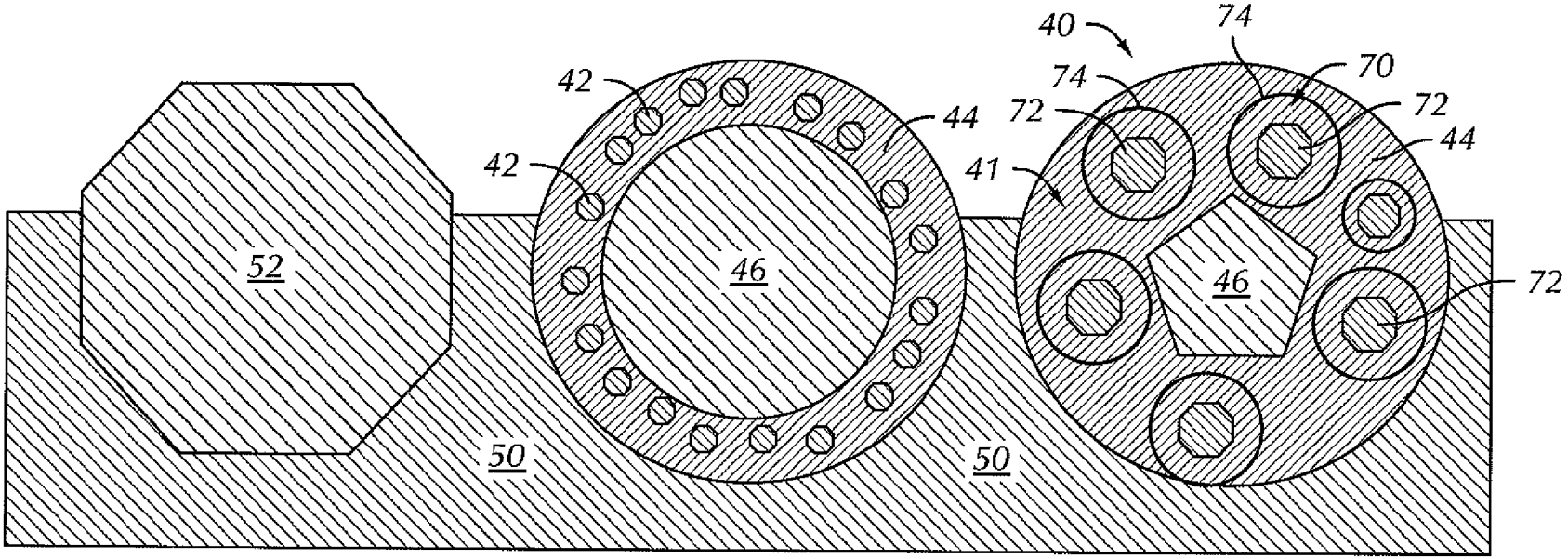
FIG. 10 illustrates a cross section of an embodiment of the encapsulated abrasive infiltrated into a rib of a drill bit or hot pressed into GHI.

As mentioned above, in some embodiments, shell 41 may be formed from matrix 44 and abrasive particles 42, including encapsulated diamonds. Referring now to FIG. 10, an encapsulated particle containing encapsulated diamonds is illustrated. A large particle 46 may be encapsulated by shell 41, a mixture of abrasive particles 42 and matrix 44. Abrasive particles 42 may include encapsulated diamonds 70: a diamond 72 encapsulated in a matrix 74.

Similar to the formation of encapsulated particles 40 described above, an exemplary method for achieving uniformly coated diamonds 70 is to mix the diamonds 72, matrix 74, and a binder in a commercial mixing machine. The resultant mix may then be processed through a granulator, returning uniformly coated diamonds 70. For example, diamond particles suitable for use in embodiments disclosed herein may include those described in U.S. Patent Publication No. 2006/0081402. These encapsulated diamonds may be mixed with matrix material 44 and processed as described above.

In some embodiments, matrix 74 and matrix 44 may have a similar composition. In other embodiments, matrix 74 and matrix 44 may differ in composition. In certain embodiments, the interior coating, matrix 74, may help bond the diamond to the outer matrix coating. In other embodiments, the interior coating may reduce thermal damage to the particles.

In various embodiments, the abrasive particles 42 and 72 may include a very thin coating thereon (not shown separately). Such coatings may be applied to the abrasive particles via plating, PVD, or CVD processes and may have a thickness of up to 1.5 microns. Typical coatings that may be included on the abrasive particles disclosed herein may include, for example, Ni, Co, Fe, carbides of Ti, Si, Mo, Cr, W, or the like.

Materials commonly used for construction of bit bodies may be used in the embodiments disclosed herein. Hence, in one embodiment, the bit body may itself be diamond-impregnated. In an alternative embodiment, the bit body comprises infiltrated tungsten carbide matrix that does not include diamond. In an alternative embodiment, the bit body can be made of steel, according to techniques that are known in the art. Again, the final bit body includes a plurality of holes having a desired orientation, which are sized to receive and support the inserts. The inserts, which include coated diamond particles, may be affixed to the steel body by brazing, mechanical means, adhesive or the like.

Figure 1:
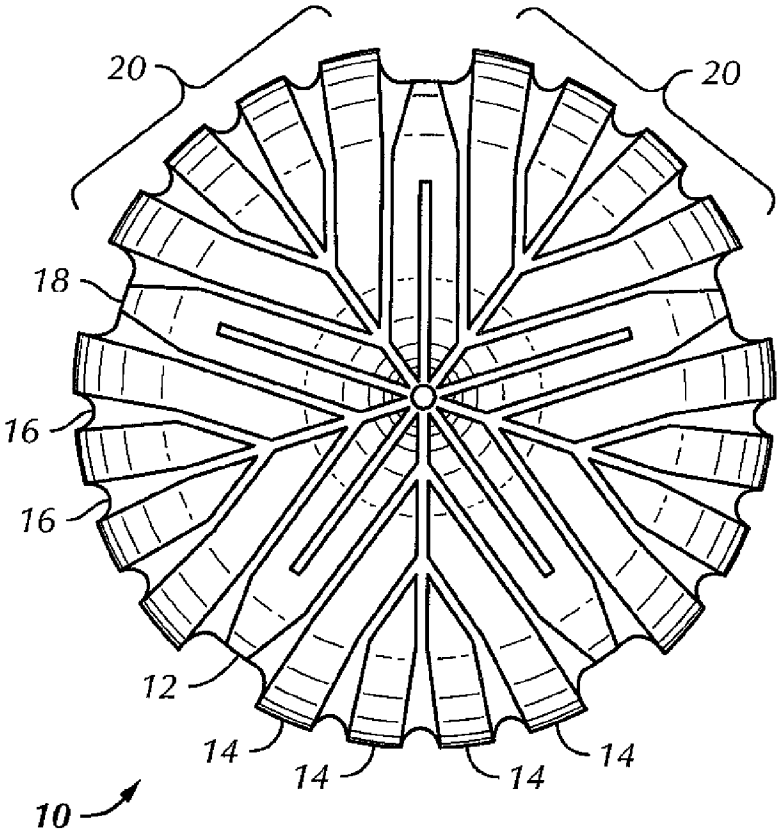
FIG. 1 (Prior Art)
FIG. 1 shows a prior art impreg bit.
Figure 2:
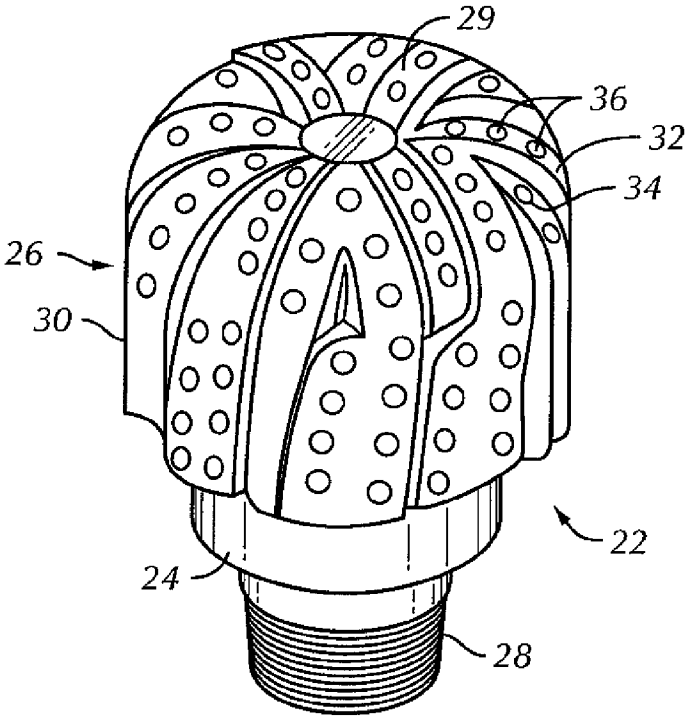
FIG. 2 (Prior Art)
FIG. 2 is a prior art perspective view of a second type of impreg bit.

Referring again to FIG. 2, impreg bits may include a plurality of gage protection elements disposed on the ribs and/or the bit body. In some embodiments, the gage protection elements may be modified to include evenly distributed diamonds. By positioning evenly distributed diamond particles at and/or beneath the surface of the ribs, the impreg bits are believed to exhibit increased durability and are less likely to exhibit premature wear than typical prior art impreg bits.

Embodiments disclosed herein, therefore, may find use in any bit application in which diamond impregnated materials may be used. Specifically, embodiments may be used to create diamond impregnated inserts, diamond impregnated bit bodies, diamond impregnated wear pads, or any other diamond impregnated material known to those of ordinary skill in the art. Embodiments may also find use as inserts or wear pads for 3-cone, 2-cone, and 1-cone (1-cone with a bearing & seal) drill bits. Further, while reference has been made to spherical particles, it will be understood by those having ordinary skill in the art that other particles and/or techniques may be used in order to achieve the desired result, namely more even distribution of diamond particles. For example, it is expressly within the scope of the present invention that elliptically coated particles may be used.

Advantageously, embodiments disclosed herein may provide for encapsulating fine diamond or CBN particles mixed with a suitable matrix, where the matrix forms a shell of abrasive particles around a large particle with a high elastic modulus. The use of finer grit surrounding a larger substrate particle with high elastic modulus may allow for a larger depth of cut to be achieved. Specifically, for a conventional abrasive particle, the "effective" depth of cut is generally one quarter to one half of the abrasive particle's diameter. As the matrix surrounding a conventional abrasive particle wears down and exposes more than half of the abrasive, the abrasive particle will typically fracture or pull out of the matrix. Embodiments disclosed herein may achieve a greater depth of cut by using encapsulated particles having a total diameter (the diameter of the large particle and the diameter of the shell surrounding the particle) than can be attained by commercially available coarse synthetic grit (which are limited to less than 1.2 mm in diameter) or other abrasives. Additionally, particles in a relatively tough shell may be less susceptible to catastrophic fracture, loosing a significant volume of material by impact load, as compared to conventional abrasive particle, thus maintaining a high depth of cut during high load and high rate of penetration (ROP) applications.

Additionally, use of fine grit may allow the bit to maintain sharp cutting elements for a longer duration than using coarse grit, because finer grit is known to have a higher strength per unit area. As discussed above, embodiments disclosed herein may provide uniform and improved wear properties, improved diamond retention, and increased diamond concentration for a given volume. Embodiments disclosed herein may also provide for the controlled exposure of fresh grit. Removal of the grit to expose fresh grit may be controlled by the hardness of the shell and particle types, and can be tailored for the rock hardness. In addition, as the shell wears down, the surface area of the shell (diamond volume) contacting the rock may vary, which may have additional benefits.

Cost efficiency may also be realized with use of embodiments disclosed herein. As abrasive particles, especially synthetic diamond crystals, increase in size, the greater the cost of the particles. For example, an increase in mesh size from −25+35 mesh to −18+25 mesh can double the price of high quality synthetic grit, with coarse natural diamond even higher in cost. Thus, embodiments disclosed herein may allow for an effective diameter of the encapsulated materials (therefore larger depth of cut) without such drastic increases in cost. Furthermore, some embodiments may include a hard particle, such as a tungsten or silicon carbide particle, that have even lower costs as compared to diamond or other superabrasives. Therefore, cost savings may be achieved while maintaining or even improving ROP, thus lowering the drilling cost per foot.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A drill bit, comprising:

a bit body;

a plurality of ribs formed on the bit body; and at least one insert attached to at least one of the plurality of ribs;

wherein the body of the at least one insert comprises:

a plurality of encapsulated particles dispersed in a first matrix material, the encapsulated particles comprising:

a coarse particle encapsulated within a shell;

wherein the shell comprises abrasive particles dispersed in a second matrix material comprising tungsten carbide, and wherein the abrasive particles are selected from the group consisting of synthetic diamond, chemical vapor deposition coated synthetic diamond, natural diamond, thermally stable polycrystalline diamond, and combinations thereof.

2. The drill bit of claim 1, wherein the coarse particle is selected from the group consisting of sintered tungsten carbide-cobalt alloy, macrocrystalline tungsten carbide, cast tungsten carbide, boron nitride, natural or synthetic diamond grit, reclaimed natural or synthetic diamond grit, thermally stable polycrystalline diamond, tungsten, silicon carbide, boron carbide, aluminum oxide, tool steel, and combinations thereof.

3. The drill bit of claim 1, wherein the tungsten carbide of the second matrix is selected from the group consisting of macrocrystalline tungsten carbide, carburized tungsten carbide, sintered tungsten carbide-cobalt alloys, cast tungsten carbide, and combinations thereof.

4. The drill bit of claim 1, wherein the second matrix further comprises a metal selected from the group consisting of cobalt, iron, nickel, copper, and combinations thereof.

5. The drill bit of claim 1, wherein the second matrix further comprises an additional component selected from the group consisting of a carbide of, vanadium, boron, titanium; a nitride of tungsten, vanadium, boron, titanium; and combinations thereof.

6. The insert of claim 1, wherein the encapsulated particles have a diameter ranging from 0.7 mm to 3.0 mm, wherein the shell has a thickness of between 0.2 to 1.0 mm, and wherein the abrasive particles range in size from 0.1 to 1.0 mm.

7. The drill bit of claim 1, wherein the coarse particle has a size in the range of from 0.3 mm to 1.5 mm.

8. The drill bit of claim 1, wherein the coarse particle has a size in the range of from 0.4 mm to 1.2 mm.

9. The drill bit of claim 1, wherein the abrasive particles range in size from 0.2 mm to 0.6 mm.

10. The drill bit of claim 1, wherein the abrasive particles are encapsulated with a third matrix material.

11. The drill bit of claim 1, wherein substantially all the insert body contains encapsulated particles.

12. An impreg drill bit, comprising:

a bit body; and a plurality of ribs formed in the bit body for engaging and abrading earthen formation; and at least one channel positioned between the plurality of ribs, wherein at least one rib is infiltrated with a plurality of encapsulated particles;

wherein the encapsulated particles comprise:

a coarse particle encapsulated within a shell;

wherein the shell comprises abrasive particles dispersed in a matrix material comprising tungsten carbide, and wherein the abrasive particles are selected from the group consisting of synthetic diamond, chemical vapor deposition coated synthetic diamond, natural diamond, thermally stable polycrystalline diamond, and combinations thereof.

13. The impreg drill bit of claim 12, wherein the coarse particle is selected from the group consisting of sintered tungsten carbide-cobalt alloy, macrocrystalline tungsten carbide, cast tungsten carbide, boron nitride, natural or synthetic diamond grit, thermally stable polycrystalline diamond, reclaimed natural or synthetic diamond grit, tungsten, silicon carbide, boron carbide, aluminum oxide, tool steel, and combinations thereof.

14. The impreg drill bit of claim 12, wherein the tungsten carbide of the matrix is selected from the group consisting of macrocrystalline tungsten carbide, carburized tungsten carbide, sintered tungsten carbide-cobalt alloys, cast tungsten carbide, and combinations thereof.

15. The impreg drill bit of claim 12, wherein the matrix further comprises a metal selected from the group consisting of cobalt, iron, nickel, copper, and combinations thereof.

16. The impreg drill bit of claim 15, wherein the matrix further comprises an additional component selected from the group consisting of a carbide of vanadium, boron, titanium; a nitride of tungsten, vanadium, boron, titanium; and combinations thereof.

17. The impreg drill bit of claim 11, wherein the encapsulated particles have a diameter ranging from 0.7 mm to 3.0 mm, wherein the shell has a thickness of between 0.2 to 1.0 mm, and wherein the abrasive particles are no greater in size than 1.0 mm.

18. The impreg drill bit of claim 12, wherein the coarse particle has a size in the range of from 0.3 mm to 1.5 mm.

19. The impreg drill bit of claim 12, wherein the coarse particle has a size in the range of from 0.4 mm to 1.2 mm.

20. The impreg drill bit of claim 12, wherein the abrasive particles range in size from 0.2 mm to 0.6 mm.

21. The impreg drill bit of claim 12, wherein the abrasive particles are encapsulated with a further matrix material.

22. The impreg drill bit of claim 12, wherein substantially all of the at least one rib is infiltrated with the plurality of encapsulated particles.

23. An insert for a drill bit, comprising:

a body formed of a plurality of encapsulated particles comprising:

a coarse particle encapsulated within a shell;

wherein the shell comprises abrasive particles dispersed in a tungsten carbide containing matrix material; and wherein the abrasive particles are selected from the group consisting of synthetic diamond, chemical vapor deposition coated synthetic diamond, natural diamond, thermally stable polycrystalline diamond, and combinations thereof.

24. The insert of claim 23, wherein the coarse particle has a size in the range of from 0.3 mm to 1.5 mm.

25. The insert of claim 23, wherein the coarse particle has a size in the range of from 0.4 mm to 1.2 mm.

26. The insert of claim 23, wherein the abrasive particles range in size from 0.2 mm to 0.6 mm.

27. The insert of claim 23, wherein the abrasive particles are encapsulated with a further matrix material.

* * * * *